US007270539B1

(12) United States Patent
Sujata

(10) Patent No.: US 7,270,539 B1
(45) **Date of Patent: *Sep. 18, 2007**

(54) METHOD AND APPARATUS FOR DESTRUCTION OF VAPORS AND WASTE STREAMS USING FLASH OXIDATION

(75) Inventor: Mark L. Sujata, Oak Park, CA (US)

(73) Assignee: Soil-Therm Equipment, Inc., Agoura Hills, CA (US)

( * ) Notice: Subject to any disclaimer, the term of this patent is extended or adjusted under 35 U.S.C. 154(b) by 63 days.

This patent is subject to a terminal disclaimer.

(21) Appl. No.: 10/977,203

(22) Filed: Oct. 28, 2004

Related U.S. Application Data

(60) Provisional application No. 60/514,619, filed on Oct. 28, 2003.

(51) Int. Cl.
*F23G 7/06* (2006.01)
*F23D 14/46* (2006.01)

(52) U.S. Cl. ..... 431/5; 431/8; 431/190; 431/353; 431/181; 110/238; 110/346

(58) Field of Classification Search ..... 431/190, 431/264, 202, 181, 187, 258, 354, 5, 8, 12, 431/353; 110/346, 238
See application file for complete search history.

(56) References Cited

U.S. PATENT DOCUMENTS 1,691,650 A * 11/1928 Falkenwalde ..... 239/383
4,056,068 A * 11/1977 Hafeli ..... 110/345
4,557,203 A * 12/1985 Mainord ..... 110/344
4,630,555 A * 12/1986 Guillaume et al. ..... 110/346
4,785,748 A * 11/1988 Sujata et al. ..... 110/238
4,915,038 A * 4/1990 Sujata et al. ..... 110/346
5,611,196 A * 3/1997 Wilson ..... 60/39.11
6,106,278 A * 8/2000 Andersson et al. ..... 431/243

FOREIGN PATENT DOCUMENTS

DE 43 20 044 A1 * 12/1994
EP 1 193 443 A2 * 4/2002

* cited by examiner

*Primary Examiner*—Josiah C. Cocks
(74) *Attorney, Agent, or Firm*—Richard S. Erbe

(57) ABSTRACT

A burner assembly for the destruction of noxious vapors and other waste streams includes an inner burner element in the form of a sudden expansion burner and an outer burner element that encircles the inner burner element and forms an annular passageway between the two elements. Waste vapors may be conducted directly into the flame of the inner burner element (direct inject) or routed through the annular passageway and preheated, for injection at the flame or beyond. The burner elements may include solid or perforated cones mounted on their exits to enhance mixing and injection of the streams. The burner assembly may be equipped with water injection nozzles for flash oxidation of contaminants in waste waters.

21 Claims, 6 Drawing Sheets

METHOD AND APPARATUS FOR DESTRUCTION OF VAPORS AND WASTE STREAMS USING FLASH OXIDATION

RELATED APPLICATIONS

This application claims the benefit of U.S. Provisional Patent Application No. 60/514,619, filed Oct. 28, 2003, incorporated herein by reference.

BACKGROUND OF THE INVENTION

1. Field of the Invention

The present invention relates to a device and methods for the destruction of noxious pollutants and contaminants. More particularly, it relates to a device and methods for the destruction of contaminants consisting of non-flammable, flammable, or combustion-inhibiting constituents which cause flameout of the direct flame. The device and methods described provide for destruction of as many as three different waste sources at the same time: 1) Volatile Organic Compounds (VOC's) and off-gas pollutants; 2) combustion products and noncombustible VOC's and contaminants; and (3) hydrocarbon liquids, wastewater or groundwater contaminated with contaminants such as MTBE, TBA, benzene, gasoline, or other similar compounds.

2. General Background and State of the Art

Hazardous materials and waste materials represent a serious challenge to human and animal health and to the environment as well. It is common to use thermal oxidizers or burner systems to destroy certain hazardous streams (such as streams containing VOC vapors, water vapor, high $CO_2$, and low $O_2$) through the use of high temperatures, known conventional burner systems employ heat transfer and minimal flame involvement that requires excessive retention times for destruction. Furthermore, the destruction efficiency of known burner systems results in marginal destruction efficiencies, which are less efficient in energy recovery from VOC's.

It has been found that improved methods of sustaining a high degree of mixing and turbulence is achieved through downstream perforated and nonperforated cones and other obstructions of varying types, which enhance the destruction and complete oxidation of pollutants.

As found in 'ramjet' combustion technology, the use of cones and downstream flame holders offer a greater degree of mixing and flame holding during the flame combustion operation, which has been shown in a wide range of aerospace ramjet and ram air burners used by the United States Department of Defense in recent years. It has been found that in practical applications, similar flame holding techniques through the use of downstream cones having baffles, orifices, slots, holes and other types of openings that produce an increase in mixing of the combustion products ensures a much higher degree of destruction and energy utilization than prior art systems. Furthermore, as found in ramjet and afterburners for defense applications; it has been shown that a direct correlation exists between the mass exchange rate in the recirculation zones of baffle flame holders and flame propagation rates, and the correlation indicates that the heat release rate in the wake behind these types of flame stabilizers controls the combustion rate downstream, which is also closely correlated to turbulence parameters and geometries.

There exists a need for a device and method of destroying vapors and/or liquids contaminated with hydrocarbons, chlorinated compounds, toxics and other volatile and nonvolatile materials that are removed or are the result of various environmental cleanup, engine exhaust, industrial processes, and any other remediation procedures.

More specifically, there exists a need for a device and method that enables the destruction of hydrocarbon emissions and other contaminants that have elevated concentrations of those contaminants which may be difficult to destroy or are resistant to oxidation by 'direct flame' processing due to their inability to sustain combustion. These processes, such as those where high concentrations of CO2 and/or low O2 are present, as well as other constituents, inhibit 'direct flame' oxidation by snuffing out the flame propagation process by the nonflammable constituents present in the vapors that are to be destroyed.

There also exists a need for a device and method that achieves destruction of vapors through direct flame destruction and/or downstream secondary flame destruction, without the secondary flame destruction process impeding the destruction capability of the primary turbulent flame process in destroying VOC compounds.

There exists a need for a method whereby noxious vapors may be manually or automatically directed for direct flame or secondary flame destruction of the vapors, so that the method can be optimized for the application such that vapors that could or are likely to extinguish the flame by virtue of its constituents may be destroyed by either a combination of direct flame and/or downstream catalytic operation and/or secondary flame processing.

Furthermore, there exists a need for the integration of known turbulent combustion technologies (such as those found in U.S. Pat. Nos. 4,785,748 [Sujata, et al.], 5,381,659 [Loving], and 5,572,866 [Loving, et al.]) with a device and method that directs the flame process into maximizing contact with noxious vapors for either preheating, partial oxidation, or complete oxidation as required by the individual process needs and goals as mandated by air pollution regulations and agencies. The integration of existing technologies with split flows of vapors concurrently into the direct flame zone and a secondary flame zone, where the vapors are forced around and through items such as solid cones, perforated cones, nozzles or tubes enables much greater operating flexibility to achieve the desired effect of mixing and thereby achieving greater levels of destruction of noxious vapors for environmental cleanup and industrial applications.

There also exists a need for a device and method for the destruction of noxious emissions and combustion products found in diesel and Otto cycle engine processes that have elevated emissions levels of carbon dioxide, carbon monoxide, low oxygen levels, and noxious unburned or partially burned hydrocarbons. Such a process would enable either manual or automatic processing of these vapors either through a direct flame or a secondary, downstream flame destruction operation so as to not impede the continuous operation of the burner from flameouts that are likely to occur from the noncombustible characteristics of the influent noxious products of combustion.

There further exists a need for a device for destroying noxious vapors that is simple in operation, easy to maintain, and able to process varying vapor flows as required for the continuous destruction of varying compound concentrations.

There also exists a need for a device and method for the destruction and elimination of water vapor and accompanying contaminants in a manner that is energy efficient and provides for the atomization of water (or other liquids, including various hydrocarbons) in order to achieve heating of the water to a gaseous state prior to destruction as well as the destruction of any VOC's present in the vapor streams by direct flame or secondary flame pathways. Such a device would virtually eliminate water and VOC vapors contaminated with a wide variety of toxic compounds.

There also exists a need for a device and methods for processing multiple waste vapor and liquid streams at the same time by providing an extremely strong flame holder by creating numerous individual circulation zones and intimate and direct consumption of vapors and pollutants within these zones.

There exists a need for a device and methods for an "all-in-one" destruction capability of contaminants that result from environmental cleanup, remediation and compliance operations that will destroy 1) volatile organic compounds ("VOC's") in the air, 2) VOC's extracted from water vapor, 3) VOC's and extracted groundwater, and 4) contaminants in industrial waste water.

SUMMARY OF THE INVENTION

The burner system and methods of the present invention satisfy all of the foregoing needs. The burner system of the present invention, generally known as a "sudden expansion burne" consists of a substantially cylindrically-shaped inner burner element fabricated of a high temperature resistant alloy or ceramics having an open end and a smaller inlet end to receive incoming noxious vapors entering by way of a duct assembly. A removable ring injector assembly, which may have several individual or multi-headed fuel injector nozzles mounted to the inner burner assembly. It is at this point that the fuel injector nozzles spray supplemental fuel (propane, natural gas, liquids, or other hydrocarbon fuel) to support the combustion and destruction of the incoming vapors.

The spray pattern of the supplemental fuel injectors is such that fuel is directed into the incoming vapor stream toward the inlet, where combustion takes place within the sudden expansion region where the inlet joins the larger end of the inner burner element. Recirculation zones located just downstream of the supplemental fuel injectors are created, which supports the turbulent mixing and flame holding aspect of the burner system operation.

The supplemental burner fuel injectors may be located at the edge of the inner burner element at the edge of the sudden expansion inlet/burner zone, recessed towards the outer edge of the inner burner element where required for stable burner operation, or as required for desired operational effects.

An outer burner element encircles and contains the inner burner element, forming an annular passageway between the two elements, in an arrangement that allows combustion air, contaminated vapors, or a mixture of them to be routed directly to the burner for destruction. Alternatively, contaminated vapors may pass either concurrently or in a countercurrent flow pattern by injecting some of the vapors directly through the burner and the rest of the vapors through the annular passageway.

The primary pathway for incoming vapors is through an entry portion that connects to the inner burner element inlet, directing the vapors directly into the flame. The second pathway for incoming vapors is provided by means of a connection mounted at the plate connecting the inner and outer burner elements that allows a mixture of air and a second vapor stream to pass through the annular passageway between the burner elements for preheating prior to injection into the flame and exhaust gases from the inner burner element.

Vapors or air passing through the annular passageway pass over the outside of the inner burner element and are directed towards orifices or tubes that direct the flow of vapors into the stream of hot exhaust gases from that portion of the vapors that were directly injected into the flame in the inner burner element. A cone or exhaust plenum may be incorporated at the end of the inner burner element to enhance the destruction process and the flame retention capabilities of the burner system of the present invention.

The bypass vapor stream (the stream passing through the annular passageway) often contains high quantities of noxious and noncombustible gasses that do not promote flame propagation. For this reason, the operator may direct the vapors to a region where they cannot affect or extinguish the flame.

Solid or perforated cones may be mounted to the ends of either or both of the inner burner element and the outer burner element to conduct the vapors, increase mixing and turbulence, and to inject the bypass vapors to the optimal location for the destruction process.

In one embodiment of the invention, the burner assembly is configured with a converging perforated cone mounted to the end of the inner burner element and a converging solid outer cone mounted to the end of the outer burner element. In this arrangement, vapors are passed directly through the inner burner element for direct flame destruction and ambient air is passed through the annular passageway. The ambient air blends with the hot exhaust gases in the space between the inner and outer cones and is heated quickly. The passage of ambient air through the annular passageway keeps the burner cooled and preheats it for energy conservation.

In another aspect of the invention, water spray injection may be added at a number of locations, including in the vapor 'direct inject' assembly, the annular passageway, the annular cone space, beyond the cone annular space, into a venturi mixing cone section, or outside of the burner assembly, all in a multitude of configurations, arrangement, nozzle types (air mixing and hydraulic) and at a wide range of process flow rates. A water stream containing hydrocarbon contaminants is sprayed into the burner assembly. The resulting atomization of the spray generates a fog. The water portion of the fog is evaporated, but the hydrocarbon contaminants in the water are 'flash oxidized' and destroyed by the burner flame.

The burner system of the present invention minimizes the generation of wastewaters requiring disposal, while destroying products of combustion and noxious vapors simultaneously. This type of operation promotes energy conservation by utilizing the heat generated by destruction operations for the destruction of contaminants in wastewater. The destruction of MTBE and TBA constituents of groundwater may be provided by the present invention, Further improvements over prior art burner systems include the downstream mixing of the exhaust gases with added liquids, vapors, or products of combustion for destruction or 'flash evaporation' of additional waste streams. In the interest of energy conservation, the burner system of the present invention achieves excellent results for environmental and industrial process applications where waste streams from a number of sources, such as vapors from a paint booth (requiring destruction by direct injection), emissions from a diesel engine (destruction of VOC's by pass injection), and contaminated storm water with petroleum of hydrocarbon contaminants (evaporation) may be processed at the same time.

Further advantages of the present invention will become more apparent from the following description of the preferred embodiments, which, taken in conjunction with the accompanying drawings, will illustrate, by way of example, the principles of the invention.

BRIEF DESCRIPTION OF THE DRAWINGS

The foregoing and other objects, aspects and advantages will be better understood from the following detailed description of the preferred embodiments of the invention with reference to the drawings in which.

DETAILED DESCRIPTION OF THE PREFERRED EMBODIMENTS OF THE INVENTION

In the following description of the invention, reference is made to the accompanying drawings, which form a part thereof, and in which are shown, by way of illustration, exemplary embodiments illustrating the principles of the present invention and how it may be practiced. It is to be understood that other embodiments may be utilized to practice the present invention, and structural and functional changes may be made thereto without departing from the scope of the present invention.

Figure 1:
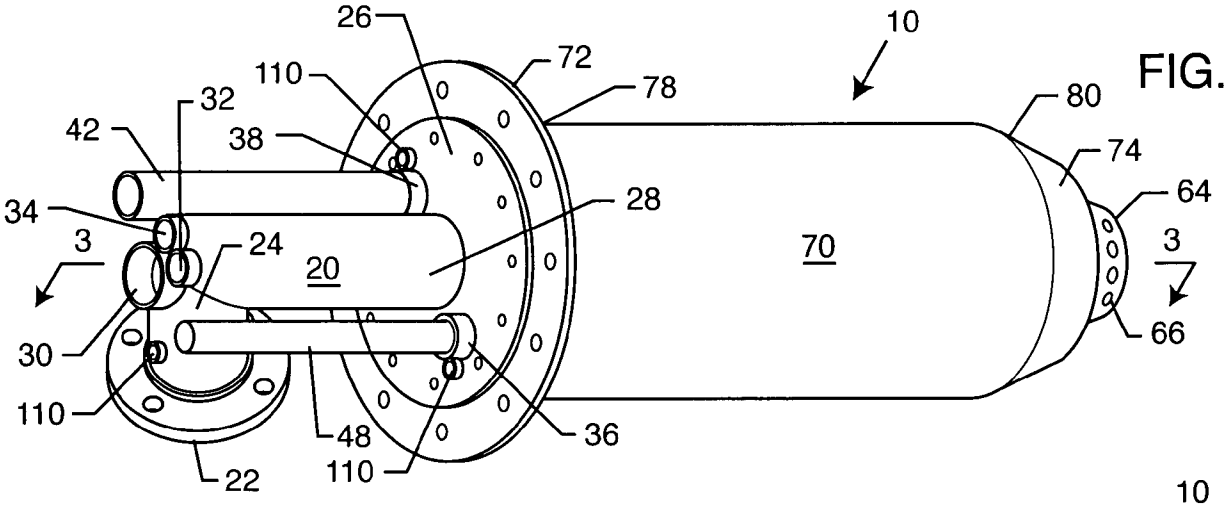
FIG. 1 illustrates a perspective view of a preferred embodiment of a burner system according to the present invention.
Figure 2:
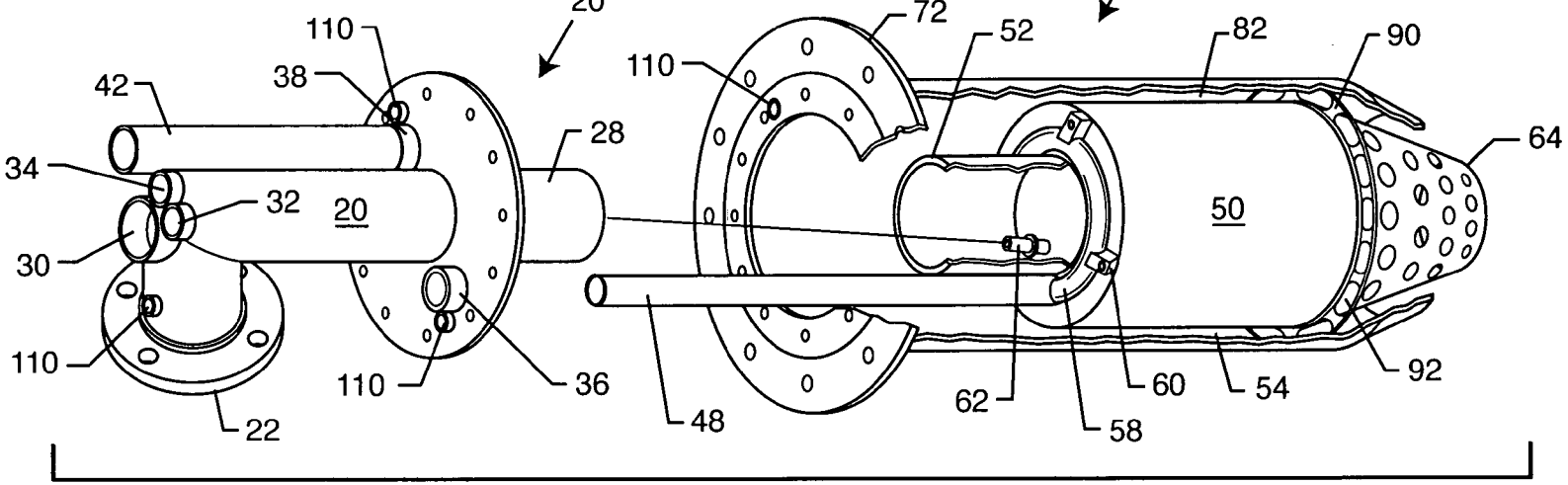
FIG. 2 illustrates an exploded perspective view of a preferred embodiment of burner system according to the present invention.
Figure 3:
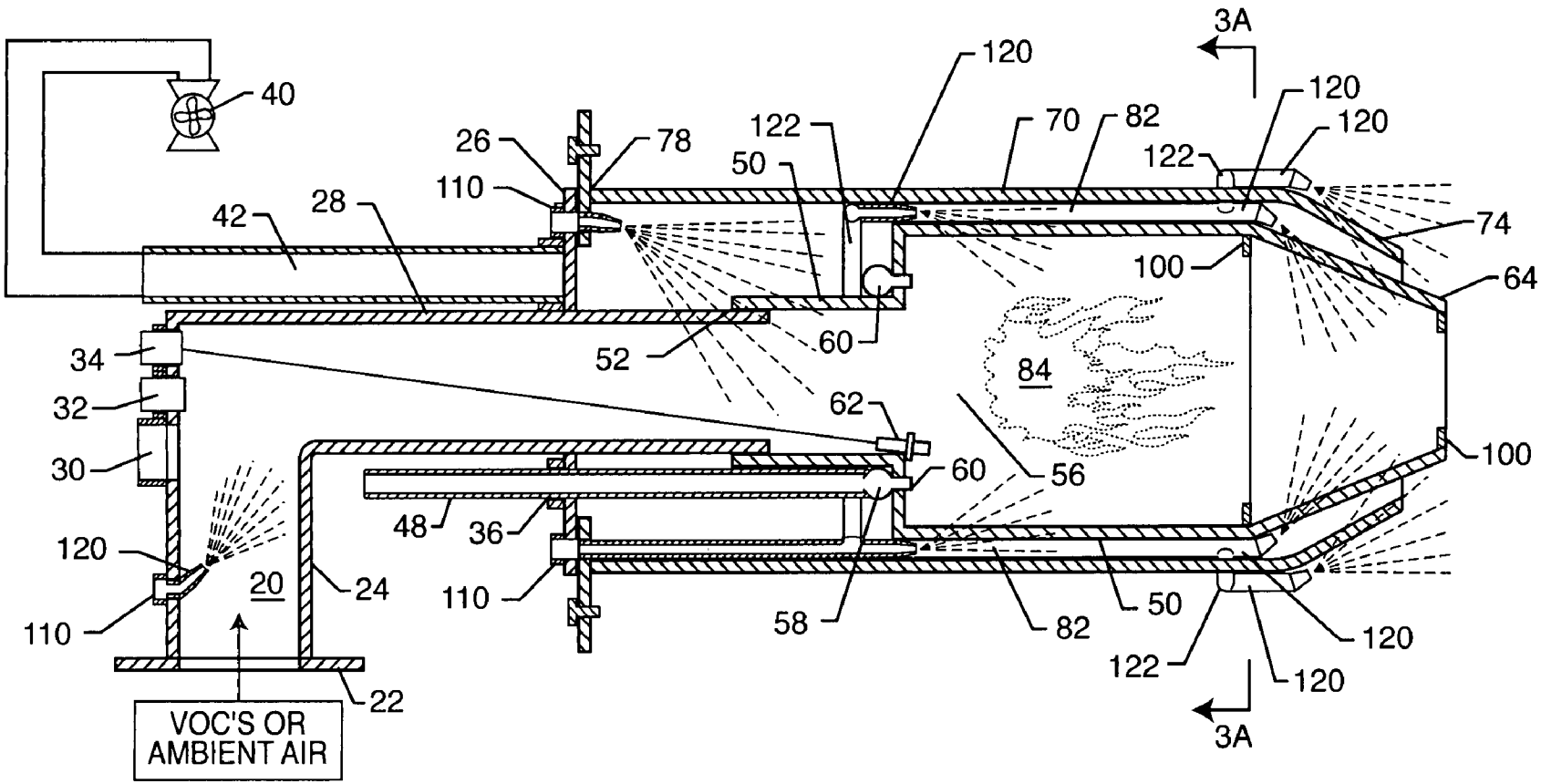
FIG. 3 illustrates a sectional side view of a preferred embodiment of a burner system according to the present invention.

The preferred embodiment of a burner assembly according to the present invention is illustrated in FIGS. 1-3, and is generally referred to by the reference numeral 10. Burner assembly 10 is generally configured of a generally tubular inner burner element 50, which fits into a generally tubular outer burner element 70. The products of combustion and exhaust gases from burner assembly 10 are directed into a thermally-lined chamber, which includes a thermal lining composed of refractory or ceramic wool, where proper temperatures are maintained for the destruction of exhaust gas components.

Inner burner element 50 includes a front inlet 52 for receiving vapors and waste streams for direct flame destruction. Inner burner element 50 is what is commonly known as a "sudden expansion burner", because the inlet 52 is of a smaller diameter than back end 54. The change in diameters from inlet 52 to back end 54 creates a very turbulent zone, which enhances mixing of combustibles and fuels and forms combustion zone 56.

Inner burner element 50 includes a supplemental fuel distribution header 58 to provide fuel to supplemental fuel nozzles 60 located adjacent combustion zone 56. Supplemental fuel, which may be methane, propane, or other hydrocarbons, is sprayed into the combustion zone 56 and ignited by a spark from spark igniter 62. The mixing of the ignited supplemental fuel with the incoming vapors or waste stream caused by the configuration of the sudden expansion burner provides for more complete destruction of the pollutants and contaminants introduced to burner assembly 10.

Outer burner element 70 surrounds inner burner element 50. The front end 78 and the back end 80 of outer burner element 70 are of the same diameter. Front end 78 includes mounting flange 72, where the components of burner assembly 10 are attached to one another.

Outer burner element 70 is spaced apart from inner burner element 50. The space in between the two forms annular passageway 82, where waste streams, vapors, and/or ambient air can be caused to flow for cooling or preheating and injection into combustion zone 56 or downstream from the combustion zone into the products of combustion.

Waste streams and vapors are conducted into burner assembly 10 by means of influent assembly 20. Influent assembly 20 includes entrance port 22, entrance portion 24 and exit portion 28, which slides into inlet 52 for direct injection into combustion zone 56. Entrance portion 24 is attached to plate 26, which is attached to flange 72 on outer burner element 70. While entrance portion 24 is shown as having an elbow in the accompanying figures, those skilled in the art will recognize that entrance portion 24 may be straight, angled, elbowed, or other configurations, without departing from the scope of the invention.

Entrance portion 24 and plate 26 include ports and connection points for some of the other elements of burner assembly 10. Sight port 30 enables the operator to view the conditions inside inner burner element 50 and may also be used for direct injection of combustion air where the influent stream contains primarily noncombustible or combustion-inhibiting contaminants, such as a low oxygen and/or high carbon dioxide waste stream.

UV/flame detector port 32 allows the operator to monitor the condition of flame 84. Entrance portion 24 also serves as the attachment point for spark igniter port 34 for connecting the required electrical circuitry for operation of spark igniter 62.

Supplemental fuel is provided to supplemental fuel nozzles 60 by fuel supply line 48, which enters burner assembly 10 through supplemental fuel port 36 located on plate 26.

Bypass port 38 is also located in plate 26 and provides an entry for cooling air or for a second waste vapor stream (or a mixture of air and vapor) into annular passageway 82. The waste vapor/cooling air is propelled by fan 40 through supply duct 42 to bypass port 38, as better illustrated in FIGS. 3-6.

Several optional components may be utilized in conjunction with burner assembly 10 to customize and enhance the effectiveness of destruction operations. FIGS. 1-2 illustrate outer mixing cone 64 and inner mixing cone 74, which are optional for use with burner assembly 10.

Burner assembly 10 also includes a number of ports 110 for injection of water in a stream, a spray or a mist. As will be seen in the burner configurations described, water ports 110 allow waste water to be sprayed into burner assembly 10 at various locations for flash oxidation of the contaminants contained in the wastewater, as well as for cooling. In the destruction operations of waste water and/or groundwater that has various ranges of contaminants, the installation of spray or fogging injector nozzles 120 in water ports 110 enables the cooling of inner burner element 50 and preheating of the waste water prior to additional flame or post-flame zone heating. In FIGS. 1 and 2, water ports 110 are shown on influent assembly 20, plate 26, and flange 72. Injector nozzles 120 may also be located in the side of the thermally-lined chamber in which exit gases from burner assembly 10 are processed.

Depending on the destruction efficiencies and toxic compounds requiring destruction, an optional inner mixing cone 64 may be attached or removed to back end 54 of inner burner element 50 as needed. Inner mixing cone 64 enables higher mixing and stronger flame holding characteristics to resist flameouts that may occur during operation under varying concentrations and flow rates of influents and when encountering lower levels of inert atmospheric gases and chlorinated compounds. Destruction of these compounds may be greatly increased through the use of inner mixing cone 64, which may be solid or have openings 66 to allow the escape of hot exhaust along the length of inner mixing cone 64. Inner mixing cone 64 may be completely constricted or restricted to various size openings at the downstream end, as needed.

FIG. 2 also illustrates mixing ring 90 in annular passageway 82. Mixing ring 90 includes openings 92 to promote turbulence and mixing of the air or vapor stream in annular passageway 82 with the gases traveling through inner burner element 50.

FIG. 3 illustrates a preferred embodiment of the burner assembly 10 according to the present invention. In this embodiment of the invention, burner assembly 10 is enabled to effectively vaporize and destroy waste waters, including groundwater, storm-drain runoff, liquid wastes, and other materials requiring permanent destruction or disposal. By integrating a vaporizing nozzle 120 injected into the vapor stream in influent assembly 20, the water vapors are mixed in with the vapors for direct flame destruction.

In this embodiment of the invention, numerous locations for water spray nozzles 120 may include plate 26 for spraying into annular passageway 82; attached to inner burner element 50 where the spray enables cooling of inner burner element 50 and preheats the water vapors prior to entering the annular passageway 82; and at the back end 80 of outer burner element 70 for directed spraying with the air or vapor into annular passageway 82.

Figure 3A:
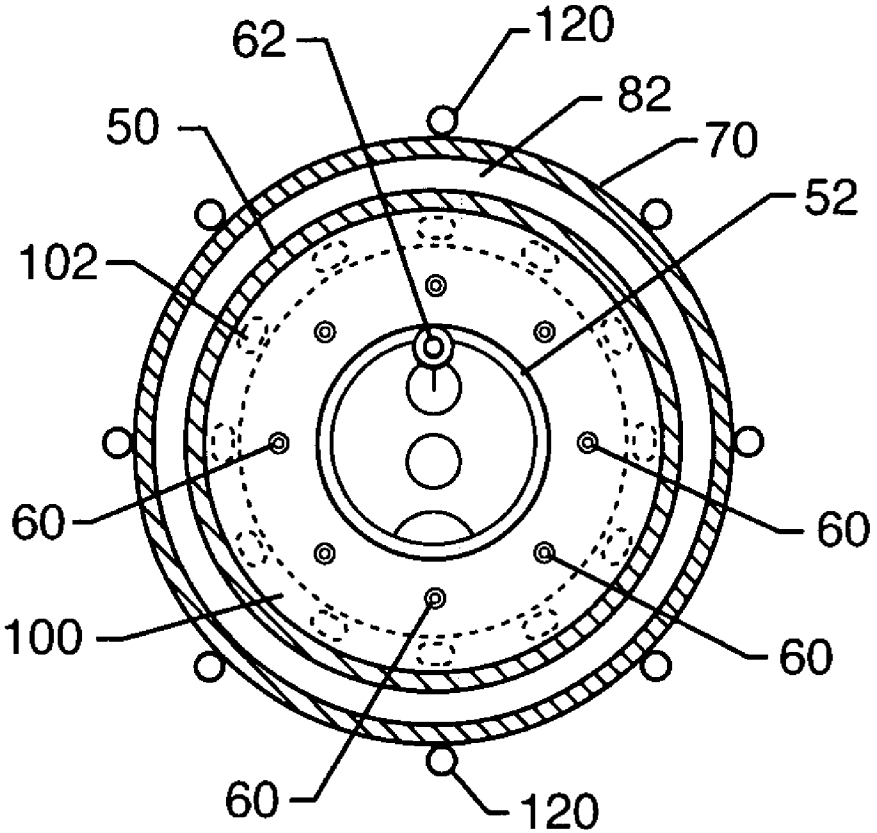
FIG. 3A illustrates a sectional view taken at line 3A-3A in FIG. 3.

FIG. 3A illustrates a view of inner mixing ring 100, which is disposed in inner burner element 50 to create turbulence and enhance the mixing of fuel, vapor, and flame. Inner mixing ring 100 may include openings 102. Inner mixing ring may be located in a variety of positions, such as at back end 54 or adjacent the exit of inner mixing cone 64.

Figure 4:
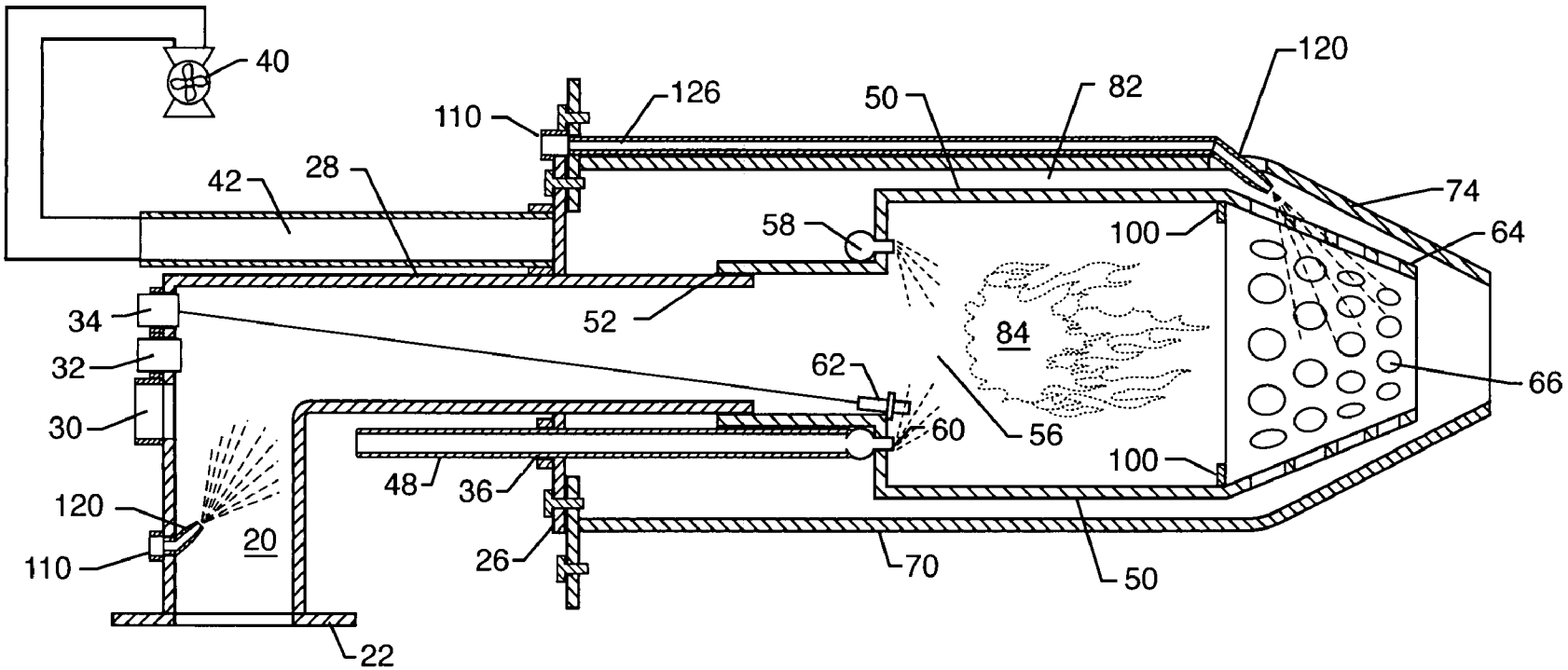
FIG. 4 illustrates a sectional side view of a second embodiment of a burner system according to the present invention.

FIG. 4 illustrates a second embodiment of a burner assembly 10 according to the present invention. In this embodiment of the invention, waste water or ground water is injected into burner assembly 10 for destruction. By utilizing water port 110 in plate 26, water (and compressed air, if required) is conducted by supply pipe 126 to spray nozzle 120 along the outside of outer burner element 70 and inside burner assembly 10 by means of another water port 110. A spray, mist, or fog is created that is injected into annular passageway 82 or over outer cone 74, depending on the spray orientation that is optimal. The angle of the spray may be from ten degrees to 180 degrees into annular passageway 82.

The spray is then "flash evaporated" and contaminants destroyed by the flame through the perforations 66 and/or the heat from inner cone 64 and combustion zone 56. The resulting mixture of the hot combustion gases resulting from waste vapors entering through influent assembly 20 and bypass port 38 and waste water from nozzle 120 is conducted in a highly turbulent environment that ensures high destruction efficiencies of the VOC content of the vapor streams.

Inner cone 64 can be perforated or solid, depending on the requirements for direct flame involvement of waste water and the constituents of the waste vapors passing through annular passageway 82. Mixing continues through to where the exhausts from inner cone 64 an outer cone 74 converge, with destruction continuing through the exhaust of outer cone 74 and through to the refractory-lined chamber until exhausted to a stack. This embodiment of the invention utilizes a single wide angle spray nozzle 120 for the water. The water stream may consist of all types of waters or wastes that may be the result of environmental cleanups and industrial waste waters from industrial processes, storm drain water, groundwater contaminated with MTBE (Methyl-Tert-Butyl Ether) and TBA (Tert Butyl Alcohol), oily water wastes, groundwater extraction and drilling processes, carwashes, and other applications where wastewaters are produced.

Figure 5:
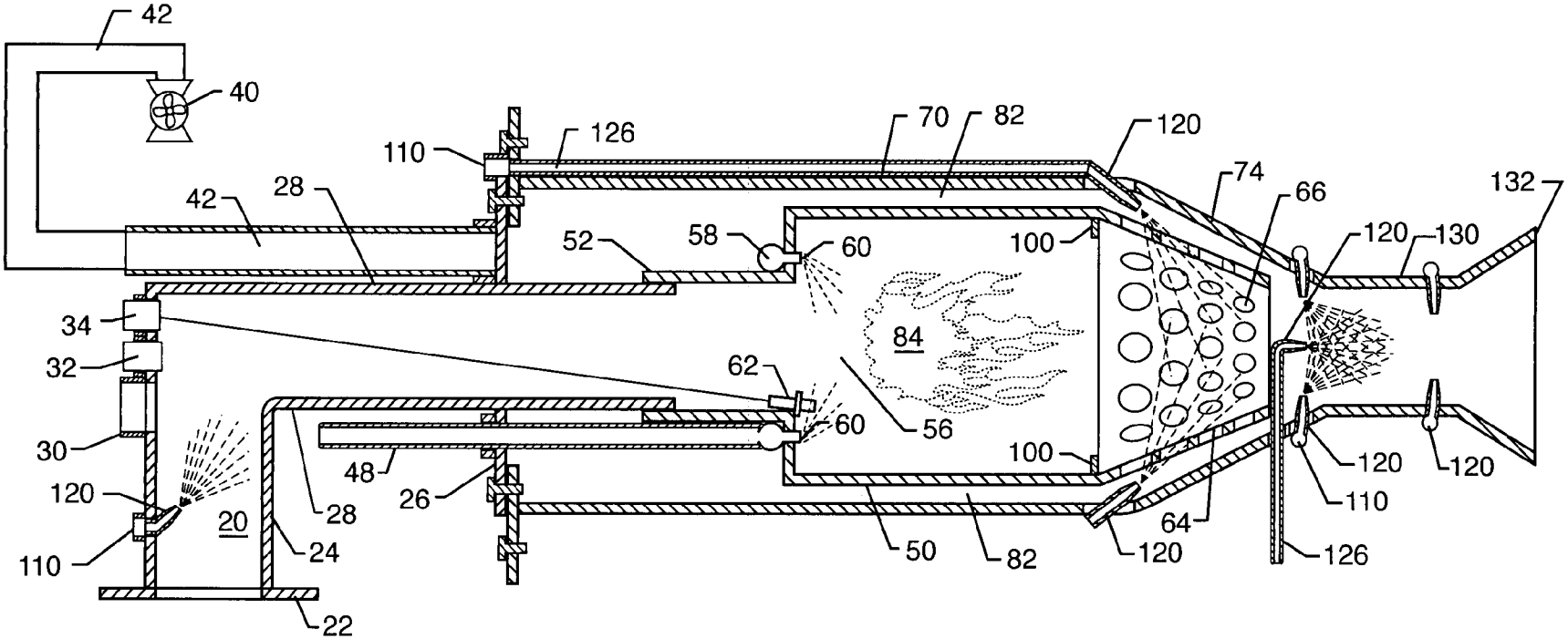
FIG. 5 illustrates a sectional side view of a third embodiment of a burner system according to the present invention.

FIG. 5 illustrates a third embodiment of the present invention. This embodiment of the invention allows for various types of water (which may also include noxious vapors, fuels, VOC's and waste liquids) spraying locations with various types of nozzles in and around burner assembly 10, and it may be that the best orientation for the burner assembly is in a vertical-downward arrangement in order to direct all water flow to the bottom of the surrounding combustion chamber and oxidizer shell and insulation.

The addition of spray nozzles 120, with directional spraying, includes spraying into annular passageway 82 with a mist or fog. The spray is directed towards the hot regions and flame regions near the perforations 66 in inner cone 64 in order to 'flash off' the water, which helps in the destruction of hazardous VOC's or content from flame 84 extending into inner cone 64 and exhausting the combined mixtures into a the restricted exhaust of annular space 82. In this embodiment of the invention, the annular space may be as small as 0.001 inch or as large as two inches, depending on the requirements of the application.

After the exhaust gases flow down outer cone 74, they encounter additional water spray nozzles 120 located at the end of outer cone 74. There may be from one to twelve water spray nozzles at this location, depending on the mixing, quenching, and water/exhaust gas mixing requirements at exit 132. Water spray nozzles 120 at the end of outer cone 74 may be either hydraulic or air atomizing spray nozzles into or in front of the restriction typically found in a venturi section 130 of this embodiment of the invention. Venturi section 130 may also include an additional mixing ring 100, which may or may not be perforated. The length of the straight portion of venture section 130 is sized to optimize mixing of hot exhaust gases and atomized wastewaters.

Figure 6:
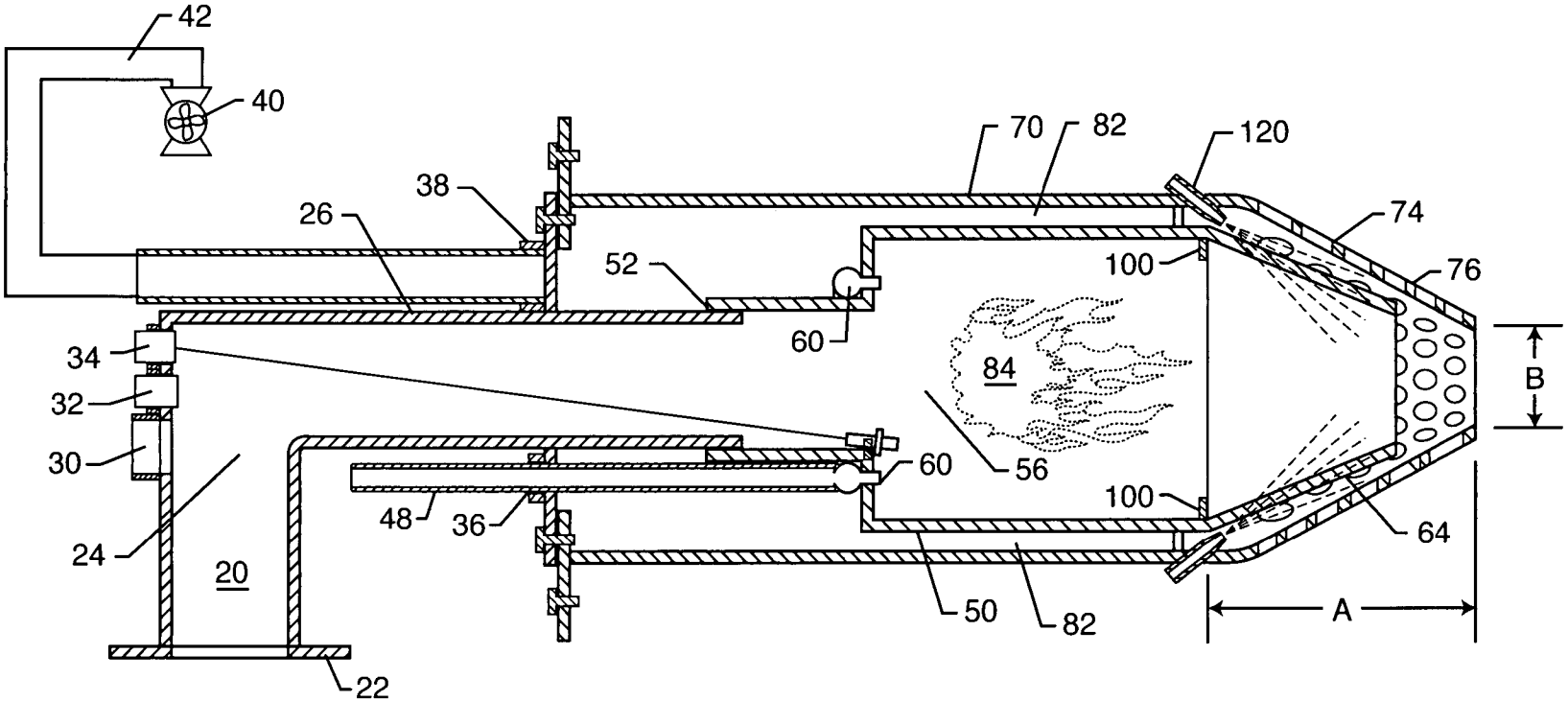
FIG. 6 illustrates a sectional side view of a fourth embodiment of a burner system according to the present invention.

FIG. 6 illustrates a fourth embodiment of the present invention. This configuration of burner assembly 10 features the 'flash oxidation and evaporation' of ground water or waste waters for the destruction of VOC content of the ground water by heat and flame of the combustion process. Inner cone 64 may be perforated or solid in this embodiment of the invention. Several water spray nozzles 120 (which may be mechanically or air atomized) may be employed in order to enable water vapor injection rates required for site cleanup and that are permissible within the size of the space located between inner cone 64 and outer cone 74.

Water spray nozzles 120 in this embodiment of the invention are connected at water ports 110 located in back end 80 of outer burner element 70. The angle of spray is variable, so that it may be directed as required to maximize waste water oxidation and destruction of waste water constituents. The length "A" of outer cone 74 varies from ¼ to 20 times the length of inner cone 64, which in this embodiment of the invention is solid. The width "B" of the outlet of outer cone 74 varies from ¼ to two times the length of inner cone 64.

The foregoing description of the exemplary embodiments of the present invention have been presented for purposes of enablement, illustration, and description. It is not intended to be exhaustive of or to limit the present invention to the precise forms discussed. There are, however, other configurations for burner systems not specifically described herein, but with which the present invention is applicable. The present invention should therefore not be seen as limited to the particular embodiment described herein; rather, it should be understood that the present invention has wide applicability with respect to burner systems. Such other configurations can be achieved by those skilled in the art in view of the description herein. Accordingly, the scope of the invention is defined by the following claims.

What is claimed is:

1. A burner system for destruction of vapors and a waste water stream containing hydrocarbon contaminants comprising:

a generally tubular elongated outer burner element having a sidewall, a front end having an opening, an opposed open back end, and a flange mounted to said front end;

a generally tubular elongated inner burner element disposed within and spaced inwardly from said outer burner element, said inner burner element being open at opposed front and back ends thereof, including a small diameter front inlet and a larger diameter combustion zone at said back end;

an annular passageway formed between the inner burner element and the outer burner element for bypassing cooling air past and around the flame so that vapors may be consumed downstream of the flame;

a vapor duct assembly connected to said front inlet, said vapor duct assembly including a duct portion, and a step plate attached to said duct portion and said flange;

a spark igniter connected to said vapor duct assembly and passing through said front inlet and into said combustion zone;

at least one fuel ignition device mounted to said inner burner element at said combustion zone;

one or more cooling water spray nozzles in said burner system;

at least one spray nozzle for spraying said waste water stream into said burner system and to atomize the water component;

a bypass opening connected to said step plate in fluid connection with said annular passageway; and a fan located adjacent the front end of the burner system connected to said bypass opening for moving air or vapors into said annular passageway.

2. The burner system according to claim 1, further comprising an outer mixing ring disposed in said annular passageway, said ring having a plurality of openings therein.

3. The burner system according to claim 1, further comprising a converging inner mixing cone connected to the back end of said inner burner element.

4. The burner system according to claim 1, further comprising a converging outer mixing cone connected to the back end of said outer burner element.

5. The burner system according to claim 4, further comprising a converging inner mixing cone connected to the back end of said inner burner element.

6. The burner system according to claim 5, further comprising a plurality of openings in said inner mixing cone.

7. The burner system according to claim 5, further comprising a plurality of openings in said inner mixing cone.

8. The burner system according to claim 3, further comprising a plurality of openings in said outer mixing cone.

9. The burner system according to claim 1, wherein said cooling water spray nozzles are located in said vapor duct assembly.

10. The burner system according to claim 1, wherein said waste water spray nozzles is located in said annular passageway.

11. The burner system according to claim 2, wherein said waste water spray nozzles is located at said outer mixing ring.

12. The burner system according to claim 4, further comprising a venturi section attached to the outer mixing cone, said venturi section comprising:

a cylindrical duct section; and a diverging conical section.

13. The burner system according to claim 12, wherein said cooling water spray nozzles are located at said venturi section.

14. The burner system according to claim 5, wherein the length of said outer cone is between ¼ to twenty times the length of said inner cone.

15. The burner system according to claim 5, wherein the width of the outlet of said outer cone is between ¼ to two times the length of said inner cone.

16. A method for the destruction of waste vapors and a waste water stream containing hydrocarbon contaminants comprising the steps of:

providing an elongated chamber having a sidewall, a front end with an opening, and an opposite open back end;

providing a sudden expansion burner having an inlet and a back end disposed within said chamber having a relatively small diameter inlet, a relatively larger diameter, elongated combustion zone, and at least one fuel nozzle extending into said combustion zone and an inner mixing cone located at said back end;

providing an outer burner element having a front end and a back end, and an outer mixing cone located at said back end;

providing a fan located adjacent the front end of the elongated chamber;

forming an annular passageway between said burner and said outer burner element;

injecting a waste vapor/air mixture into said annular passageway;

providing a spray nozzle to inject said waste water stream into said outer burner element and atomize the water component to form a fog;

injecting a water spray into said chamber;

passing waste vapors into said combustion zone;

injecting fuel from said fuel nozzle into said combustion zone;

igniting the vapors and the fuel in the combustion zone to produce heat and flame;

evaporating the fog; and flash oxidizing the hydrocarbon contaminants.

17. The method according to claim 16, further comprising the steps of:

restricting the flow of air and vapors in the annular passageway; and restricting the flow of vapors and combustion products in said sudden expansion burner.

18. The method according to claim 17, further comprising the step of:

injecting the waste vapor/air mixture from said annular passageway around and between the inner mixing cone and the outer mixing cone to mix with the flame and heat.

19. A method for the destruction of a first vapor waste stream, a second vapor waste stream, and a waste water stream containing hydrocarbon contaminants in a single burner assembly comprising the steps of:

providing an elongated chamber having a sidewall, a front end with an opening, and an opposite open back end;

providing a sudden expansion burner disposed within said chamber having a relatively small diameter inlet, a relatively larger diameter, elongated combustion zone, and at least one fuel nozzle extending into said combustion zone;

providing a fan located adjacent said front end of said elongated chamber;

forming an annular passageway between said burner and said chamber;

providing a spray nozzle to inject said waste water stream into said annular passageway;

injecting said waste water stream into said annular passageway and atomizing the water component of said waste water stream to form a fog;

injecting the first waste vapor stream into said annular passageway;

injecting the second waste vapor stream into said combustion zone;

injecting fuel from said fuel nozzle into said combustion zone;

igniting the air and the fuel in the combustion zone;

evaporating the fog; and flash oxidizing the hydrocarbon contaminants.

20. The method according to claim 19, further comprising the step of:

injecting the first waste vapor stream into said combustion zone.

21. A method for the destruction of a waste vapor stream and a waste water stream containing hydrocarbon contaminants comprising the steps of:

providing an elongated chamber having a sidewall, a front end with an opening, and an opposite open back end;

providing a sudden expansion burner disposed within said chamber having a relatively small diameter inlet, a relatively larger diameter, elongated combustion zone, and at least one fuel nozzle extending into said combustion zone;

providing a fan located adjacent said front end of said elongated chamber;

forming an annular passageway between said burner and said chamber;

providing an atomizing spray nozzle for injecting the waste water stream into the annular passageway;

injecting said waste water stream into said annular passageway and forming a fog from the water;

injecting the waste vapor stream into said annular passageway and said inlet;

injecting fuel from said fuel nozzle into said combustion zone;

igniting the air and the fuel in the combustion zone;

evaporating the fog; and flash oxidizing the hydrocarbon contaminants.

* * * * *